United States Patent [19]

Lemelson et al.

[11] 4,069,613

[45] Jan. 24, 1978

[54] ACTIVITY DOLL

[76] Inventors: Jerome H. Lemelson, 85 Rector St., Metuchen, N.J. 08840; William B. Nutting, 829 Feorgia St., Imperial Beach, Calif. 92032

[21] Appl. No.: 660,804

[22] Filed: Feb. 24, 1976

Related U.S. Application Data

[63] Continuation of Ser. No. 376,466, July 5, 1973, abandoned, which is a continuation-in-part of Ser. No. 297,451, Oct. 13, 1972, Pat. No. 3,758,982.

[51] Int. Cl.[2] ..... A63H 13/04

[52] U.S. Cl. ..... 46/120

[58] Field of Search ..... 46/142, 143; 46/118, 46/119, 120, 148, 151; 273/87.4

[56] References Cited

U.S. PATENT DOCUMENTS

| | | | |
|---|---|---|---|
| 525,716 | 9/1894 | McElroy | 46/119 |
| 1,127,861 | 2/1915 | Connor et al. | 273/87.4 |
| 1,605,738 | 11/1926 | Idemoto | 46/142 |
| 1,660,277 | 2/1928 | Schreer | 46/10 X |
| 2,548,237 | 11/1943 | Pearson | 46/120 |
| 2,638,348 | 5/1953 | Arenson et al. | 46/148 X |
| 2,764,841 | 10/1956 | Birnbaum | 46/119 |
| 2,975,533 | 3/1961 | Burns | 46/119 X |
| 3,106,800 | 10/1963 | Fletcher | 46/118 X |
| 3,235,259 | 2/1966 | Glass et al. | 46/118 X |

FOREIGN PATENT DOCUMENTS

| | | | |
|---|---|---|---|
| 765,875 | 3/1934 | France | 46/142 |
| 826,717 | 1/1952 | Germany | 46/142 |
| 162,432 | 5/1921 | United Kingdom | 46/143 |

*Primary Examiner*—F. Barry Shay
*Attorney, Agent, or Firm*—Wigman & Cohen

[57] ABSTRACT

A doll is provided having a hollow body with one or more pivotally mounted limbs arranged for movement from a normally retracted position at the side or in front of the body to an actuated position at a higher location or across the body by operating a manual actuator such as a depressible member which is accessible to the rear of the body. In another embodiment, a mechanism subassembly is constructed for selectively operating an arm and leg of a doll. The arm or leg of the doll is frictionally adjustable on its pivot mount permitting selective adjustment of the path through which movement is effected so as to permit the simulation of various human activities. In another embodiment, the limb is bendable on its mount so as to permit the simulation of still further human activities when the limb is actuated.

13 Claims, 11 Drawing Figures

FIG. 8.
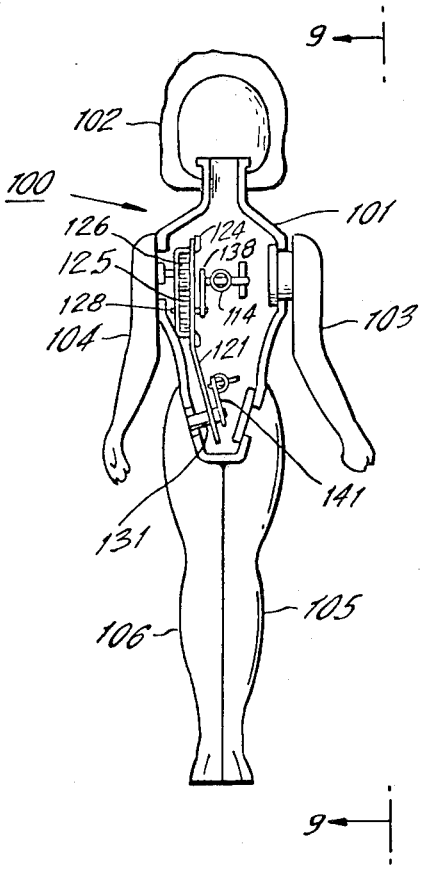
FIG. 9A.
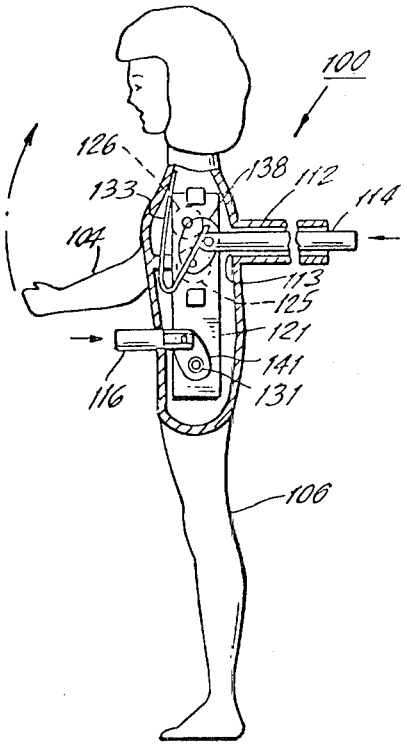
FIG. 9B.
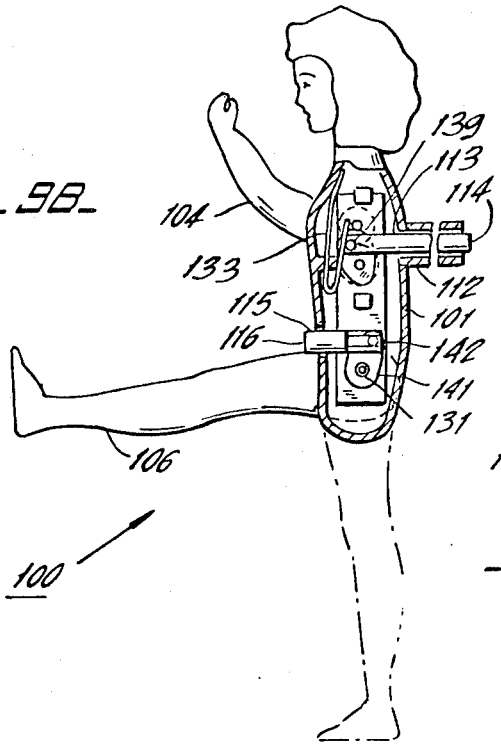
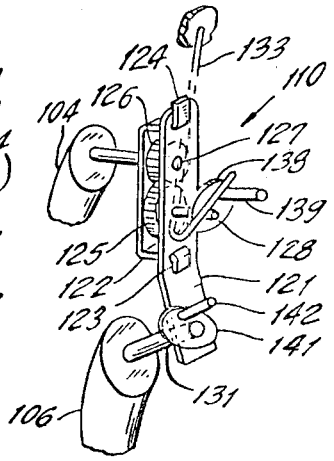
FIG. 10

ACTIVITY DOLL

RELATED APPLICATIONS

This is a continuation of Ser. No. 376,466 filed July 5, 1973 now abandoned as a continuation-in-part of Ser. No. 297,451 filed Oct. 13, 1972 now U.S. Pat. No. 3,758,982.

This invention relates to dolls in general and more particularly to constructions of manually actuated mechanisms for moving the limbs of dolls with a reciprocating motion. The prior art has provided a number of doll constructions having movable limbs. For the most part, most of these constructions involve the movement of the limb by direct manual operation or by means of a motor wherein the path of movement for a particular cycle is always predetermined thereby permitting the doll operation to simulate a single and particular activity. Mechanisms which have heretofore involved more complex operation than the single stroke movement of a limb such as movement in a plurality of directions, are extremely complex both in structure and operation.

As will hereinafter be described in detail, the instant invention provides a rugged, compact, manually actuated mechanism for moving the limb of a doll to simulate not one but a variety of actions similar to those made by humans. Such actions as hand waving, kiss-throwing, pointing, eating, drinking, brushing, object throwing, kicking, cleaning, ironing and dusting may all be simulated, using the mechanism of the instant invention by providing simple means for manually, frictionally pre-adjusting the limb on its mount so that when it is operated thereafter by the actuator, the path through which the limb is pivoted and swings may be varied from one extending from the downward vertical position of the limb or rearwardly thereof to a variety of locations upwardly therefrom and ending from a position below the horizontal to one in which the limb is directed vertically upwardly or to the rear of the torso of the doll. The limb is caused to pivot across the body, an angular adjustment is provided to simulate, for example, bending of the limb at the elbow prior to its pivotal movement by means of the actuator so that a variety of other human activities may be simulated thereby.

Accordingly, it is a primary object of the instant invention to provide a novel and compact manually actuated mechanism for moving limbs of a doll relative to the body thereof.

Another object is to provide improvements in mechanisms for manually controlling the pivotal movement of a doll arm from a normally at-rest location in its pivotal movement across part of the doll body to its maximum degree of throw so as to permit the simulation of various activities wherein the mechanism is biased to return the limb to the at-rest location and further, wherein said at-rest location may be manually adjusted prior to operation of the doll mechanism so that the doll arm may be adjustably moved through a variety of paths to simulate a variety of human activities.

Yet another object is to provide an animated doll having a mechanism for causing a limb such as the arm thereof to pivotally swing through a particular arc and wherein the arm is either bendably adjustable along at least part of its length or frictionally adjustable about its elbow to permit a child to simulate a variety of different human activities which are accomplished by swinging movement of the human arm while the lower arm thereof is in a variety of different attitudes with respect to the upper arm.

A still further object is to provide a mechanism of this type in which the depressible member, when depressed, positively drives the limb in a forward direction and upon reaching the end of its stroke, the member automatically releases the limb to permit a biasing means to return the limb to its normal position.

With the above and such other objects in view as may hereafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed.

Figure 1:
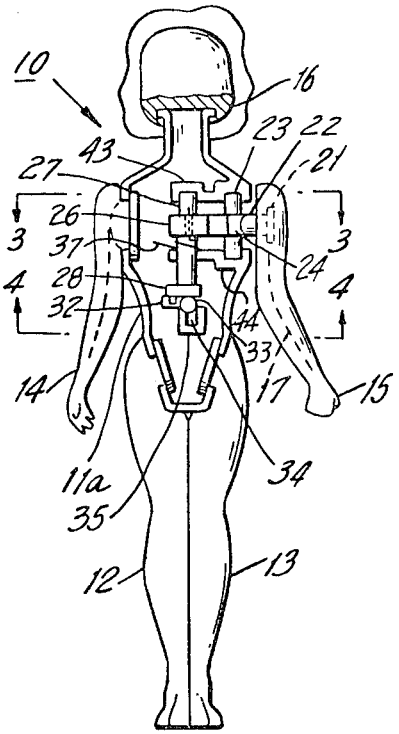
FIG. 1 is a rear elevation of a doll constructed in accordance with the teachings of the instant invention and having the rear body section removed to reveal the limb operating mechanism inside the doll body.
Figure 3:
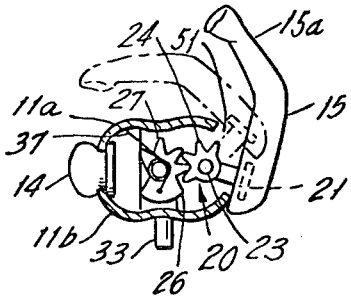
Figure 4:
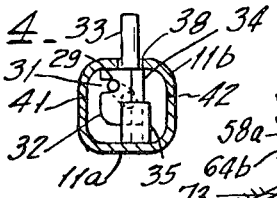

FIGS. 3 and 4 are cross-sections taken through lines 3—3 and 4—4 respectively, of FIG. 1 looking in the directions of the respective arrows 3—3 and 4—4.

Figure 5:
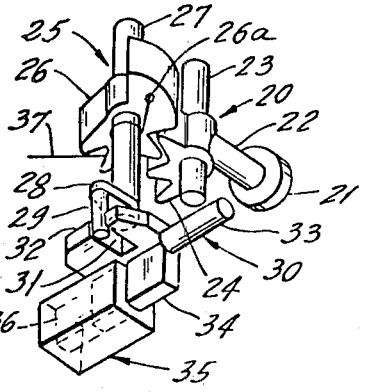

FIG. 5 is a perspective view of the limb operating mechanism for the doll of FIG. 1.

Figure 6:
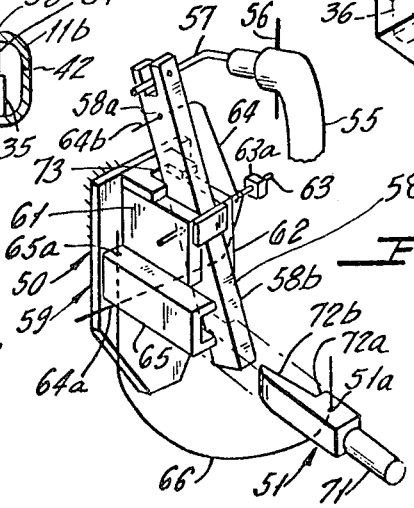

FIG. 6 is a perspective illustrating another embodiment of a limb operating mechanism constructed in accordance with the teachings of the instant invention.

Figure 7:
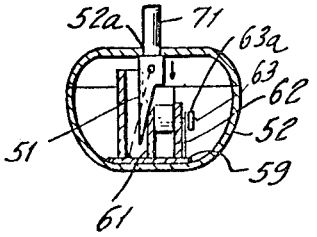

FIG. 7 is a cross-section taken in a horizontal plane extending through the mechanism of FIG. 6 when mounted in a doll body.

FIG. 8 is a front elevation of an activity doll with its front body section removed to reveal another embodiment of a limb operating mechanism.

FIGS. 9A and 9B are side elevations looking in the direction of arrows 9—9 of FIG. 8 with the near wall of the body removed to reveal the operating mechanism. In FIG. 9A the mechanism operable arm and leg are shown in their normal positions while in FIG. 9B these limbs are each actuated to raised positions.

FIG. 10 is a perspective of the subassembly comprising the limb operating mechanism.

Now referring to the Figures and more particularly to FIGS. 1 through 5 showing animation doll 10 including hollow structure having body 11, legs 12, 13, arms 14, 15 and head 16. Arm 14, legs 12, 13 and body 11 are constructed of relatively rigid injection molded plastic such as cellulose acetate or rigid vinyl while arm 15 and head 16 are constructed of flexible vinyl. In a manner well known to the art, arm 14, legs 12, 13, and head 16 are each mounted to body 11 with a friction fit enabling these body appendages to remain in adjusted positions.

Figure 2:
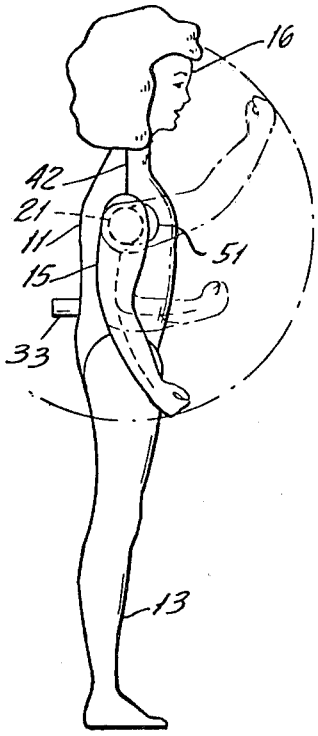
FIG. 2 is a side elevation of the doll of FIG. 1.

Arm 15 is provided with an internal longitudinally extending bendable stiffening wire 17 which permits arm 15 to be bent at the elbow and to remain in such bent position as illustrated in the phantom positions of FIG. 2. It is noted that the bent position of arm 15 in FIG. 3 differs from the positions of arm 15 in FIGS. 1 and 2. The upper end of arm 15 is frictionally fitted to disk 21, which lies in a vertical plane, so that arm 15 may also be adjusted angularly about the center of disk 21 as a pivot. Disk 21 is part of molded plastic member 20 which also includes extension 22, stub shaft 23 and spur gear segment 24 formed about shaft 23 as a center. Extension 22 is at right angles to shaft 23 with the longitudinal axis of extension 22 projecting through the center of disk 21 at right angles to the plane thereof.

The teeth of gear 24 are in mesh with the teeth of spur gear segment 26 forming part of another molded plastic member 25. Member 25 also includes stub shaft 27, extension 28 and crank pin 29. Gear 26 is formed about shaft 27 as a center. Shaft 27 and pin 29 are offset from one another with their respective longitudinal axes extending parallel to the longitudinal axis of shaft 23. Crank pin 29 extends into slot 31 in the horizontal section 32 of depressible operator member 30. Member 30 includes manually engageable extension 33 and guide portion 34 slideably mounted in guide slot 36 of member 35. Coil spring 37 is wound about the portion of shaft 27 just below gear 26 with one end of spring 37 extending into gear aperture **26*a* and the other end of spring 37 abutting the inner surface of the front body portion 11*a* so as to bias gear 26 in a counterclockwise direction with respect to FIG. 3**.

Extension 33 projects through aperture 38 in rear section **11*b* of body 11. Body sections 11*a*, 11*b* are bonded together along vertical seams 41, 42, in a manner well known to the art, and each is provided with cooperating internal formations 43, 44, which, as seen in FIG. 1, provide bearing supports for shafts 23 and 27. Body 11 also includes elongated aperture 51 which provides clearance for the movement of extension 22. Spring 37 biases the operating elements 20, 25 and 30 to the solid line position of FIG. 3**.

By manually engaging and depressing operator extension 33, that is moving extension 33 toward front body portion **11*a*, slot 31 moves forward causing crank pin 29 to rotate clockwise with respect to FIG. 3 thereby rotating shaft 27 and gear 26 carried thereby in a clockwise direction. The teeth of gear 26 being in engagement with the teeth of gear 24 cause gear 24 to move counterclockwise with respect to FIG. 3 to pivot extension 22 counterclockwise. This motion of gear 24 moves disk 21 from the rear toward the front of body 11 carrying arm 15 bodily toward the front of body 11 from the solid line position of FIG. 3 to the phantom position thereof. When extension 33 is released, spring 37 returns operating elements 20, 25, 30 and arm 15 to their positions of FIG. 3**.

FIGS. 6 and 7 illustrate another embodiment of the instant invention wherein a single forward stroke of the manual operator member 51 causes arm 55 to move through a complete front to rear cycle without the necessity of releasing member 51. More particularly the upper end of arm 55 is pivotally mounted to fixed pin 56 and is provided with stiff wire extension 57 projecting into the space formed at the bifurcated upper end section of lever 58. Lever 58 is part of operating mechanism 50 which includes mounting member 59 fixedly secured to the interior surface at the front of doll body 52 (FIG. 7). Member 59 includes spaced parallel guide walls 61, 62 on opposite sides of lever 58. Pin 63 is force fitted into aligned apertures of wall 61, 62 and passes through a relatively loose fitting aperture at a point intermediate the ends of lever 58 to pivotally mount lever 58. Torsion spring 64 having the mid-portion thereof wound about the portion of pin 63 to the right of wall 62 in FIG. 6 and is retained by block **63*a* on pin 63. End 64*a* is held in fixed position by extending through an aperture in mounting member 59. The other end 64*b* of spring 64 extends through aperture 58*a* of lever 58 with spring 64 being loaded to exert a forwardly directed force on the upper portion of lever 58**.

Mounting member 59 also includes rearwardly extending guide channel 65 within which operating member 51 is slideably mounted. Wire spring 66 extending through aperture **65*a* of channel 65 and aperture 51*a* of member 51 biases the latter rearward and to the right with respect to FIG. 6 (to the left with respect to FIG. 7) toward the lower portion of lever 58. Normally, extension 71 of member 51 projects outside of body 52 through rear aperture 52*a* being biased to this position by spring 66. In this normal position for member 51, step 72*a* thereof is positioned behind rear surface 58*b* of lever 58**.

As member 51 is moved forward, step surface **72*a* in engagement with lever surface 58*b* forces the lower end of lever 58 forward so that the upper end of lever 58 pivots rearward thereby operating arm 55 in a counterclockwise direction about its pivot 56. During this forward movement of member 51 inclined surface 72*b* thereof is in engagement with guide wall 61, the latter being a fixed formation which acts on the former as a cam means. By the time member 51 has just about reached the limit of its forward movement the cooperation of inclined surface 72*b* and wall 61 cams step 72*a* sideways with respect to lever 58 to a position where lever 58 is no longer engaged by member 51. Under these conditions, spring 64 operates the upper end of lever 58 forward thereby pivoting arm 55 in a counterclockwise direction about its pivot 56**.

Upon release of member 51, spring 66 moves member 51 rearward and when the latter is just about at its most rearward position, spring 66 is also effective to move step **72*a* behind lever surface 58*b* so that upon the next forward actuation of operator member 51, lever 58 will be operated. It is noted that forward movement of the upper end of lever 58 is limited by engagement with formation 73 of mounting member 59**.

Activity doll 100 of FIGS. 8 through 10 includes hollow body 101, head 102, arms 103, 104, and legs 105, 106. Operating mechanism subassembly 110 mounted within body 101 is connected to arm 104 and leg 106 for positive operation of these limbs by depressible operators 114, 116, respectively. The former operator 114 extends through aperture 113 in the rear of body 101 and the latter operator 116 extends through aperture 115 in the front of body 101. Arm operator 114 extends through tube 112 projecting rearwardly from body 101. Tube 112 is provided for conveniently holding and "walking" doll 100.

Mechanism subassembly 110 includes frame 121 and C-shaped retainer 122 having out-turned ears 123, 124. Ears 123, 124 extend through slots in frame 121 and are outwardly bent to mount retainer 122 to frame 121. Meshing spur gears 125, 126 disposed in the space between retainer 122 and frame 121 are keyed to shafts 127, 128, respectively, with both shafts 127, 128 extending through retainer 122 and frame 121 and being pivotally supported thereon. Arm 104 is keyed to the outboard end of shaft 127 while leg 106 is keyed at its upper or shoulder end to the outboard end of sub-shaft 131 also pivotally mounted to frame 121. The outboard end of shaft 128 is keyed to gear 125 while the inboard end of shaft 128 is keyed to crank 138. Pin 139 extends from crank 138 on the side thereof opposite gear 125 and is parallel to shaft 128. Wire spring 133 bears against the inner front surface of body 101 and also bears against pin 139 thereby biasing crank 138 in a clockwise direction as seen in FIGS. 9A and 9B.

Operator 114 extends at right angles to pin 139 and is provided with an aperture which receives pin 139 to provide a driving connection between operator 114 and pin 139. Thus, as operator 114 is depressed from the position of FIG. 9A to the position of FIG. 9B, crank 138 is pivoted in a counterclockwise direction against the force of spring 133 causing pivotal movement of the larger gear 125 about its axis 128. Rotation of larger gear 125 in mesh with smaller gear 125 causes multiplied angular motion of the latter so that appreciable pivotal movement of arm 104 takes place as gear 125 pivots. When operator 114 is released spring 133 acts on pin 139 to pivot crank 138 clockwise thereby lowering arm 104.

The inboard end of shaft 131 is keyed to crank 141. Pin 141 projects from the side of crank 141 opposite leg 106 and in a direction parallel to pin 131. Operator 116 is a tubular member having a cutaway portion at its inboard end and an aperture which receives pin 142. Thus, when operator 116 is depressed by being moved toward the rear of doll 100, pin 142 moves to the rear causing crank 141 to pivot clockwise about pin 131 as a center, thereby raising leg 106 to the position shown in the solid line of FIG. 9B. Upon release of operator 116 gravity bias returns leg 106 to its normal lowered position of FIGS. 8 and 9A.

Thus, it is seen that the instant invention provides simple yet rugged and compact operating mechanisms for operating the limb of a doll in a manner to simulate natural action. In one embodiment of this invention the limb pivots forward and rearward in response to front and rear movements, respectively, of a manually depressible member while in another embodiment of this invention the limb moves forward and then rearward by the time the depressible member has completed a forward stroke. While arm movement has been shown as being effectuated by a rearward extending operator, by suitable modifications arm movement may be effectuated by a depressible forwardly extending actuator.

Although there has been described a preferred embodiment of this novel invention, many variations and modifications will now be apparent to those skilled in the art. Therefore, this invention is to be limited, not by the specific disclosure herein, but only by the appending claims.

As above set forth, the doll constructions shown in the drawings and described in the specification permit a child playing therewith to make a variety of adjustments in both the attitude of the doll's arm or leg prior to actuating the same and the actual path through which the arm or leg will swing when the actuator is operated. As set forth, frictional adjustment of the articulated arm or leg on its pivot may be effected by hand moving the arm or leg beyond its at-rest position or the maximum throw thereof so as to frictionally move same to a new location and thereby permit variable adjustment of the point at which the swing of the limb is initiated as the actuator is operated and the furthermost point of swing of the limb derived by complete operation of the actuator. In other words, the arm 15 of the doll of FIGS. 1 and 2 may be frictionally adjusted on its pivot so that it normally hangs substantially vertically downwardly alongside the doll body and will thereafter swing about an arc, say 90° to a horizontal position to simulate such actions as picking up an object, rolling a ball, punching, raising the hand for simulated hand shake, etc. The arm 15 may also be frictionally adjusted so that it is in a substantially horizontally position at its starting point when the actuator is unactuated so that it will swing upwardly from said horizontal position to a location opposite or immediately in front of the face. This action may be utilized to simulate such human activities as moving an object to the face or mouth, combing the hair, eating, etc. If the arm is adjusted such that its starting is somewhat above the horizontal, it may be made to swing upwardly to simulate such activities, when the actuator is operated, as waving, putting on a hat, etc.

Bendably adjusting the arm about the elbow and properly adjusting the path of swing thereof when the actuator 33 is operated, may also permit the arm to simulate a variety of other human activities such as throwing a ball, reaching for an object which is above waist level, dusting or cleaning, etc.

Frictional adjustment of the doll arm at the elbow or shoulder to permit variation in the location of the entire arm or the forearm prior to lateral pivotal movement across the body by the actuation of mechanisms such as those illustrated in FIGS. 3 to 7 may also be provided to permit adjustable variations in the height at which the arm may be caused to pivot from one side of the torso or body towards the other side to permit the simulation of a variety of different human activities involving the lateral movement of the hand and arm across the body. For example, by providing such frictional adjustment of the elbow joint or at the shoulder, the doll may be made to simulate wiping or cleaning a table top at waist level, wiping or writing on a blackboard, wiping or dusting objects at chest or face level or above the head or perhaps even combing or brushing the hair.

It is also to be noted that the mechanisms illustrated in FIGS. 1 to 10 may be varied in construction and operation without departing from the spirit of the invention. For example, the push pin actuators of FIGS. 1 to 5 may be replaced by push-operated plate means forming part of the back wall of the doll and connected to the pin 33. Also, the manually engageable extension or pins 33 and 71 may be elongated and extending several inches or more from the doll and constructed as illustrated in FIGS. 9A and 9B or may be connected to flexible push-pull shafts for remote operation of the doll mechanism by manual or motor driven means. Furthermore, the mechanisms illustrated in FIGS. 1 to 10 may also be driven to impart pivotal movement to the doll arm and/or leg or legs by means of a battery operated electric or spring wound motor supported within or externally of the doll.

The embodiments of the invention in which an exclusive privilege or property is claimed are defined as follows:

1. An animation toy representing a human figure including a body portion having a longitudinal axis, a limb representing an arm of said figure and pivotally supported by said body portion about an axis substantially parallel to and spaced from the longitudinal axis of said body portion for pivotal movement about the shoulder joint of the arm relative to said body portion to permit said arm to swing in a path in front of and laterally across said body portion, an operator supported for guided movement on said body portion and having a first section extending into said body portion and a second section accessible from externally of said body portion for the operation of said operator from a first to a second position by application of a force thereto, an operating mechanism disposed within said body portion and connected to be engaged and operated by the movement of said operator, said arm being connected to said mechanism, said mechanism, when actuated, pivoting said arm from a normal position at one side of said body to another position after swinging across said body, biasing means urging said operator to said first position and said arm to return to said normal position after the force is released against said operator, said operator first section being in operative engagement with said mechanism to actuate the latter upon operation of said operator from said first towards said second position, said mechanism providing a driving connection between said arm and said operator as the latter moves from said first towards said second position whereby energy for moving said operator towards said second position is transmitted through said mechanism to operate said arm to cause it to pivotally swing across said body towards said another position and including means for breaking said driving connection when said operator reaches said second position whereby said biasing means operates said limb to said normal position while said operator is held in said second position.

2. An animation toy as set forth in claim 1 in which the driving connection remains intact for all positions of said limb and said operator whereby positions of said limb are related to positions of said operator for all positions of the latter.

3. An animation toy as set forth in claim 1 in which said mechanism includes pivoted meshing first and second gear means, means guiding said operator for linear movement.

4. An animation toy as set forth in claim 3 in which first and second pivots are provided for the respective first and second gear means, said first section of said operator operatively engaging said first gear means, a projection extending radially from said second pivot and mounting said limb thereon whereby said second pivot constitutes a center about which said limb moves.

5. An animation toy as set forth in claim 1 in which there is a first pivot to which said limb is mounted, said mechanism including a lever, a second pivot mounting said lever at a point intermediate its ends, said pivots being perpendicular to each other, an extension from said limb engaging one end of said lever, said operator engaging said lever at its other end.

6. An animation toy representing a human figure including a body portion, a limb representing an arm of said figure and pivotally supported by said body portion for pivotal movement about the shoulder joint of the arm relative to said body portion to permit said arm to swing in a path in front of and laterally across said body portion, an operator supported for guided movement on said body portion, and having a first section extending into said body portion and a second section projecting externally of said body portion and accessible for the operation of said operator from a first to a second position, means guiding said operator for linear movement, an operating mechanism disposed within said body portion and connected to be engaged and operated by the movement of said operator, said arm being connected to said mechanism, said mechanism, when actuated, pivoting said arm from a normal position at one side of said body to another position after swinging across said body, biasing means urging said operator to said first position and said arm to return to said normal position after force is released against said operator, said operator first section being in operative engagement with said mechanism to actuate the latter upon operation of said operator from said first towards said second position, said mechanism providing a driving connection between said arm and said operator as the latter moves from said first towards said second position whereby energy for moving said operator towards said second position is transmitted through said mechanism to operate said arm to cause it to pivotally swing across said body towards said another position, said mechanism further including pivoted meshing first and second gear means and first and second pivots provided respectively for said first and second gear means, the first section of said operator engaging said first gear means, a projection extending radially from said second pivot and mounting said limb thereon, said second pivot comprising a center about which said limb moves, a crank secured to said first pivot, said operator having a slot extending generally perpendicular to the direction of movement of said operator and a pin extending from said crank into said slot and positioned parallel to said first pivot, said pin and said slot providing a lost motion connection between said operator and said first gear means.

7. An animation toy representing a human figure including a body portion, a limb representing an arm of said figure and pivotally supported by said body portion for pivotal movement about the shoulder joint of the arm relative to said body portion to permit said arm to swing in a path in front of and laterally across said body portion, an operator supported for guided movement on said body portion and having a first section extending into said body portion and a second section projecting externally of said body portion and accessible for the operation of said operator from a first to a second position, an operating mechanism disposed within said body portion and connected to be engaged and operated by the movement of said operator, said arm being connected to said mechanism, said mechanism, when actuated, pivoting said arm from a normal position at one side of said body to another position after swinging across said body, biasing means urging said operator to said first position and said arm to return to said normal position after force is released against said operator, said operator first section being in operative engagement with said mechanism to actuate the latter upon operation of said operator from said first towards said second position, said mechanism providing a driving connection between said arm and said operator as the latter moves from said first towards said second position whereby energy for moving said operator towards said second position is transmitted through said mechanism to operate said arm to cause it to pivotally swing across said body towards said another position, said mechanism further including a first pivot to which said limb is mounted, a lever, a second pivot mounting said lever at a point intermediate the ends of said lever, said pivots being perpendicular to each other, an extension from said limb engaging one end of said lever, said operator engaging the other end of said lever, cam means mounted in said body portion, said cam means including a fixed formation, said first operator section engaging said formation as said operator moves toward said second position whereby said first operator section moves sideways away from said lever as said operator moves toward said second position and upon reaching said second position is disengaged from said lever.

8. An animation toy representing a human figure including a body portion having a longitudinal axis, a limb representing an arm of said figure, said arm having a shoulder joint, first means pivotably supporting said arm at the shoulder joint thereof about a first axis perpendicular to said longitudinal axis, second means for pivoting said arm at the shoulder joint thereof about a second axis perpendicular to said first axis to permit said arm to swing in a lateral path relative to said body portion, an operator supported for guided movement on said body portion and having a first section extending into said body portion and a second section accessible from externally of said body portion for the operation of said operator from a first to a second position, an operating mechanism disposed within said body portion and connected to be engaged and operated by the movement of said operator, said arm being connected to said operating mechanism, said mechanism, when actuated by said operator, pivoting said arm laterally with respect to said body portion about said second axis from a normal position to another position, biasing means urging said operator to the first position thereof and said arm to return to said normal position after the force applied against said operator is released, said operator first section being in operative engagement with said mechanism to actuate the latter upon operation of said operator from said first toward said second position, said mechanism providing a driving connection between said arm and said operator as the latter moves from said first towards said second position whereby the force for moving said operator towards said second position is transmitted through said mechanism to operate said arm to cause it to pivotally swing laterally relative to said body portion toward said another position.

9. An animation toy as set forth in claim 8, wherein said first means includes frictionally fitted means for permitting adjustment of said arm into a plurality of angular positions about said first axis whereby a variety of humanlike actions are simulated by actuation of said operating mechanism by said operator.

10. An animation toy as set forth in claim 9, wherein said first axis intersects said second axis.

11. An animation toy representing a human figure including a body having a longitudinal axis, said body including front and rear body portions and a shoulder joint, a limb representing an arm of said figure and supported at the shoulder joint of said body for pivotal movement about an axis non-coincident with said longitudinal axis, said arm being swingable in an arcuate path from a first position to a second position, means disposed within said body and connected to said arm for pivoting said arm between said first and second positions, a linearly-movable operator supported for guided movement on said body in a direction substantially perpendicular to said longitudinal axis between a first operator position and a second operator position, said second operator position being located inwardly toward said body relative to said first operator position, said operator having a first section extending into said rear body portion and a second operator section accessible to a finger of a hand holding said body portion for application of a force to said second operator section, means associated with said operator for biasing said operator outwardly from said second operator position toward said first operator position after release of the force applied to said second operator section, the first section of said operator being operatively engaged internally of said body with said pivoting means for swinging said arm from said first position to said second position upon application of a force to said second operator section to actuate said operator from said first operator position inwardly toward said second operator position, said pivoting means including a shaft arranged along an axis substantially parallel to said longitudinal axis, said shaft having a crank pin operatively connected thereto, the first section of said operator including means engaging said crank pin whereby upon actuation of said operator from said first operator position to said second operator position said shaft is rotated about its axis by said crank pin, said shaft having a first gear means affixed thereto and axially spaced from said crank pin, a second gear means operatively connected to said arm, said first gear means being drivingly connected with said second gear means.

12. An animation toy as set forth in claim 9, wherein said frictionally fitted means includes a disk element, said disk element being connected to said second means.

13. An animation toy as set forth in claim 8, wherein said operating mechanism includes means supported for limited rotational movement in said body portion about a third axis parallel to said longitudinal axis for interconnecting said operator with said second means whereby upon actuation of said operator from said first to said second position, said interconnecting means is rotated about said third axis thereby pivoting said arm about said second axis.

* * * * *

UNITED STATES PATENT AND TRADEMARK OFFICE

CERTIFICATE OF CORRECTION

PATENT NO. : 4,069,613

DATED : Jan. 24, 1978

INVENTOR(S) : Jerome H. Lemelson and William B. Nutting

It is certified that error appears in the above-identified patent and that said Letters Patent are hereby corrected as shown below:

Claim 10, column 9, line 37, change "9" to --8--.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*